US008573325B2

(12) United States Patent
Maida, Jr. et al.

(10) Patent No.: US 8,573,325 B2
(45) **Date of Patent: *Nov. 5, 2013**

(54) OPTIMIZED PRESSURE DRILLING WITH CONTINUOUS TUBING DRILL STRING

(71) Applicant: Halliburton Energy Services, Inc., Houston, TX (US)

(72) Inventors: John L. Maida, Jr., Houston, TX (US); Neal G. Skinner, Lewisville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/775,934

(22) Filed: Feb. 25, 2013

(65) Prior Publication Data

US 2013/0161098 A1 Jun. 27, 2013

Related U.S. Application Data

(63) Continuation of application No. 13/470,742, filed on May 14, 2012.

(51) Int. Cl.
*E21B 47/14* (2006.01)

(52) U.S. Cl.
USPC ..... 175/24; 175/50

(58) Field of Classification Search
USPC ..... 175/24, 25, 27, 50
See application file for complete search history.

(56) References Cited

U.S. PATENT DOCUMENTS

| | | | | |
|---|---|---|---|---|
| 3,905,010 | A | 9/1975 | Fitzpatrick | |
| 6,048,175 | A | 4/2000 | Corlew et al. | |
| 6,268,911 | B1 | 7/2001 | Tubel et al. | |
| 6,347,675 | B1 | 2/2002 | Kolle | |
| 6,415,877 | B1 | 7/2002 | Fincher et al. | |
| 6,588,266 | B2 | 7/2003 | Tubel et al. | |
| 7,416,026 | B2 | 8/2008 | Naquin et al. | |
| 7,580,797 | B2 | 8/2009 | Akram et al. | |
| 7,779,683 | B2 | 8/2010 | Glasbergen et al. | |
| 2002/0066309 | A1 | 6/2002 | Tubel | |
| 2004/0065477 | A1 | 4/2004 | Paulk et al. | |
| 2004/0129418 | A1 | 7/2004 | Jee et al. | |
| 2007/0221407 | A1 * | 9/2007 | Bostick et al. | 175/50 |
| 2007/0234789 | A1 | 10/2007 | Glasbergen | |
| 2010/0082258 | A1 | 4/2010 | Wang | |
| 2011/0114387 | A1 * | 5/2011 | Belcher et al. | 175/57 |

FOREIGN PATENT DOCUMENTS

| | | | |
|---|---|---|---|
| CA | 2691257 | A1 | 7/2010 |
| WO | 9850680 | A2 | 12/1998 |

OTHER PUBLICATIONS

Search Report issued Feb. 17, 2012 for International Application No. PCT/US11/38838, 6 pages.
Written Opinion issued Feb. 17, 2012 for International Application No. PCT/US11/38838, 3 pages.
Office Action issued Sep. 6, 2012 for U.S. Appl. No. 13/470,742, 11 pages.
Office Action issued Nov. 29, 2012 for U.S. Appl. No. 13/470,742, 11 pages.

* cited by examiner

*Primary Examiner* — William P Neuder
(74) *Attorney, Agent, or Firm* — Smith IP Services, P.C.

(57) ABSTRACT

A method of drilling a wellbore can include drilling the wellbore with a continuous tubing drill string, and sensing at least one parameter with an optical waveguide in the drill string. A well system can include a continuous tubing drill string, and an optical waveguide in the drill string. The optical waveguide may sense at least one parameter distributed along the drill string.

30 Claims, 5 Drawing Sheets

OPTIMIZED PRESSURE DRILLING WITH CONTINUOUS TUBING DRILL STRING

CROSS-REFERENCE TO RELATED APPLICATIONS

This application is a continuation of U.S. application Ser. No. 13/470,742 filed on 14 May 2012, which claims the benefit under 35 USC §119 of the filing date of International Application Ser. No. PCT/US11/38838, filed 02 Jun. 2011. The entire disclosures of these prior applications are incorporated herein by this reference.

BACKGROUND

The present disclosure relates generally to equipment utilized and operations performed in conjunction with drilling a well and, in an embodiment described herein, more particularly provides for optimized pressure drilling with a continuous tubing drill string.

In a conventional drilling operation, sensors at the surface and in a bottom hole assembly of a drill string can be used to detect various parameters affecting the drilling operation. However, such sensors do not measure parameters along the drill string, and are of limited usefulness in detecting an influx of fluid into a wellbore, or in detecting loss of fluid from the wellbore.

Therefore, it will be appreciated that improvements are needed in the art of sensing in drilling operations. These improvements may be useful in the situations discussed above, and in other situations.

DETAILED DESCRIPTION

Figure 1:
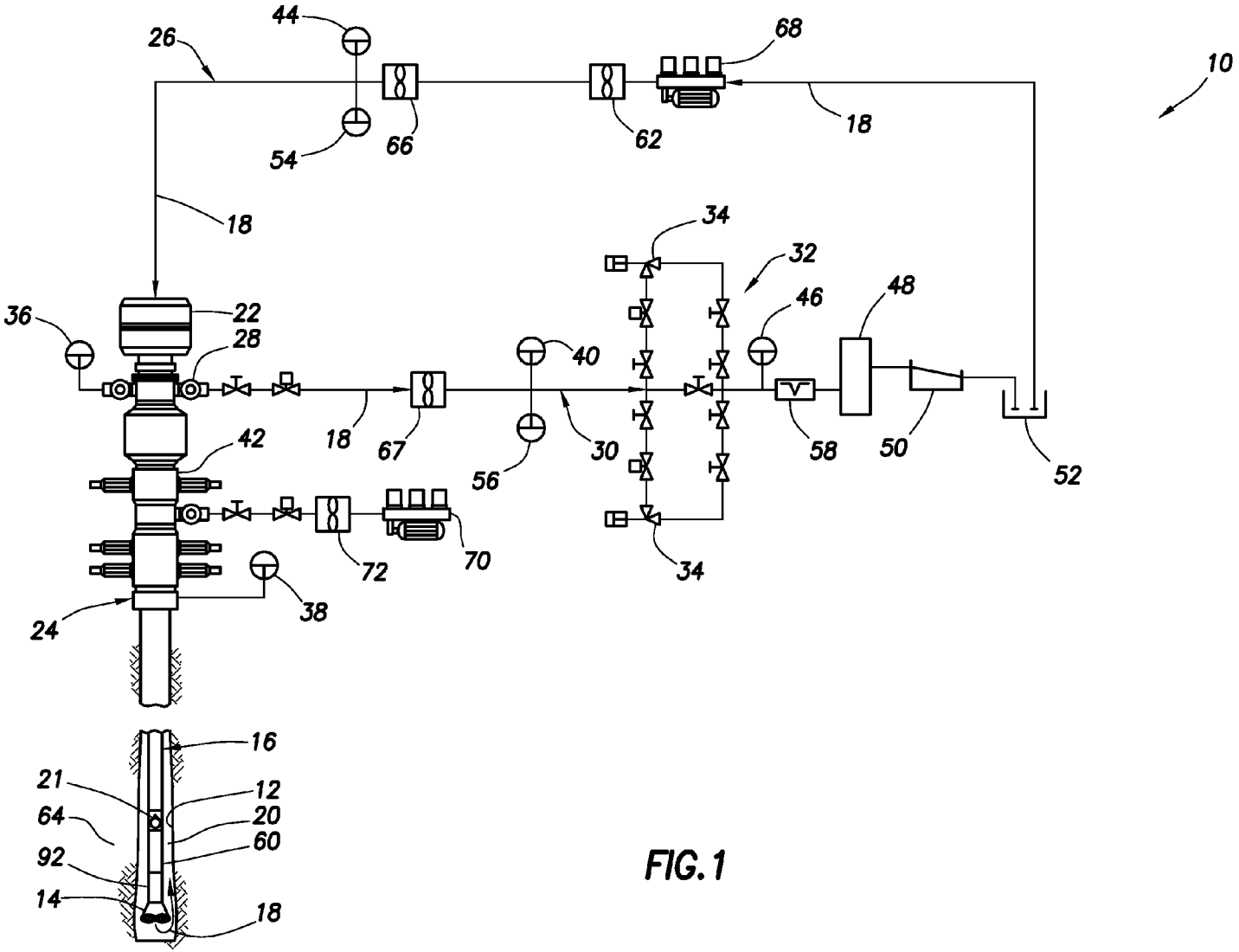
FIG. 1 is a representative partially cross-sectional view of a well system and associated method which can embody principles of this disclosure.

Representatively illustrated in FIG. 1 is a well system 10 and associated method which can embody principles of this disclosure. In the system 10, a wellbore 12 is drilled by rotating a drill bit 14 on an end of a tubular drill string 16.

Drilling fluid 18, commonly known as mud, is circulated downward through the drill string 16, out the drill bit 14 and upward through an annulus 20 formed between the drill string and the wellbore 12, in order to cool the drill bit, lubricate the drill string, remove cuttings and provide a measure of bottom hole pressure control. A non-return valve 21 (typically a flapper-type check valve) prevents flow of the drilling fluid 18 upward through the drill string 16.

Control of bottom hole pressure is very important in managed pressure and underbalanced drilling, and in other types of optimized pressure drilling operations. Preferably, the bottom hole pressure is optimized to prevent excessive loss of fluid into an earth formation 64 surrounding the wellbore 12, undesired fracturing of the formation, undesired influx of formation fluids into the wellbore, etc.

In typical managed pressure drilling, it is desired to maintain the bottom hole pressure greater than a pore pressure of the formation 64, without exceeding the fracture pressure of the formation. In typical underbalanced drilling, it is desired to maintain the bottom hole pressure somewhat less than the pore pressure, thereby obtaining a controlled influx of fluid from the formation 64.

Nitrogen or another gas, or another lighter weight fluid, may be added to the drilling fluid 18 for pressure control. This technique is especially useful, for example, in underbalanced drilling operations, or in segregated density (such as dual gradient) managed pressure drilling.

In the system 10, additional control over the bottom hole pressure is obtained by closing off the annulus 20 (e.g., isolating it from communication with the atmosphere and enabling the annulus to be pressurized at or near the surface) using a rotating control device 22 (RCD). The RCD 22 seals about the drill string 16 above a wellhead 24. Although not shown in FIG. 1, the drill string 16 would extend upwardly through the RCD 22 for connection to, for example, a standpipe line 26 and/or other conventional drilling equipment.

The drilling fluid 18 exits the wellhead 24 via a wing valve 28 in communication with the annulus 20 below the RCD 22. The fluid 18 then flows through a fluid return line 30 to a choke manifold 32, which includes redundant chokes 34. Backpressure is applied to the annulus 20 by variably restricting flow of the fluid 18 through the operative one(s) of the redundant chokes 34.

The greater the restriction to flow through the choke(s) 34, the greater the backpressure applied to the annulus 20 for a given flow rate. Thus, bottom hole pressure can be conveniently regulated by varying the backpressure applied to the annulus 20 by varying the restriction to flow through the choke(s) 34. A hydraulics model can be used, as described more fully below, to determine a pressure applied to the annulus 20 at or near the surface, which pressure will result in a desired bottom hole pressure, so that an operator (or an automated control system) can readily determine how to regulate the pressure applied to the annulus at or near the surface (which can be conveniently measured) in order to obtain the desired bottom hole pressure.

It can also be desirable to control pressure at other locations along the wellbore 12. For example, the pressure at a casing shoe, at a heel of a lateral wellbore, in generally vertical or horizontal portions of the wellbore 12, or at any other location can be controlled using the principles of this disclosure.

Pressure applied to the annulus 20 can be measured at or near the surface via a variety of pressure sensors 36, 38, 40, each of which is in communication with the annulus. Pressure sensor 36 senses pressure below the RCD 22, but above a blowout preventer (BOP) stack 42. Pressure sensor 38 senses pressure in the wellhead below the BOP stack 42. Pressure sensor 40 senses pressure in the fluid return line 30 upstream of the choke manifold 32.

Another pressure sensor 44 senses pressure in the standpipe line 26. Yet another pressure sensor 46 senses pressure downstream of the choke manifold 32, but upstream of a separator 48, shaker 50 and mud pit 52. Additional sensors include temperature sensors 54, 56, Coriolis flowmeter 58, and flowmeters 62, 66.

Not all of these sensors are necessary. For example, the system 10 could include only one of the flowmeters 62, 66. However, input from the sensors is useful to the hydraulics model in determining what the pressure applied to the annulus 20 should be during the drilling operation.

In addition, the drill string 16 may include its own sensors 60, for example, to directly measure bottom hole pressure. Such sensors 60 may be of the type known to those skilled in the art as pressure while drilling (PWD), measurement while drilling (MWD) and/or logging while drilling (LWD) sensor systems. These drill string sensor systems generally provide at least pressure measurement, and may also provide temperature measurement, detection of drill string characteristics (such as vibration, weight on bit, stick-slip, etc.), formation characteristics (such as resistivity, density, etc.) and/or other measurements. Various forms of telemetry (acoustic, pressure pulse, electromagnetic, optical, wired, etc.) may be used to transmit the downhole sensor measurements to the surface. The drill string 16 could be provided with conductors, optical waveguides, etc., for transmission of data and/or commands between the sensors 60 and the process control system 74 described below (see FIG. 2).

Additional sensors could be included in the system 10, if desired. For example, another flowmeter 67 could be used to measure the rate of flow of the fluid 18 exiting the wellhead 24, another Coriolis flowmeter (not shown) could be interconnected directly upstream or downstream of a rig mud pump 68, etc.

Fewer sensors could be included in the system 10, if desired. For example, the output of the rig mud pump 68 could be determined by counting pump strokes, instead of by using the flowmeter 62 or any other flowmeters.

Note that the separator 48 could be a 3 or 4 phase separator, or a mud gas separator (sometimes referred to as a "poor boy degasser"). However, the separator 48 is not necessarily used in the system 10.

The drilling fluid 18 is pumped through the standpipe line 26 and into the interior of the drill string 16 by the rig mud pump 68. The pump 68 receives the fluid 18 from the mud pit 52 and flows it via a standpipe manifold 86 (not shown in FIG. 1, see FIG. 3) to the standpipe line 26. The fluid 18 then circulates downward through the drill string 16, upward through the annulus 20, through the mud return line 30, through the choke manifold 32, and then via the separator 48 and shaker 50 to the mud pit 52 for conditioning and recirculation.

Note that, in the system 10 as so far described above, the choke 34 cannot be used to control backpressure applied to the annulus 20 for control of the bottom hole pressure, unless the fluid 18 is flowing through the choke. In conventional overbalanced drilling operations, a lack of circulation can occur whenever a connection is made in the drill string 16 (e.g., to add another length of drill pipe to the drill string as the wellbore 12 is drilled deeper), and the lack of circulation will require that bottom hole pressure be regulated solely by the density of the fluid 18.

In the system 10, however, flow of the fluid 18 through the choke 34 can be maintained, even though the fluid does not circulate through the drill string 16 and annulus 20. Thus, pressure can still be applied to the annulus 20 by restricting flow of the fluid 18 through the choke 34. This capability can be useful, for example, when tripping the drill string 16 into and out of the wellbore 12.

In the system 10 as depicted in FIG. 1, a backpressure pump 70 can be used to supply a flow of fluid to the return line 30 upstream of the choke manifold 32 by pumping fluid into the annulus 20 or another location upstream of the choke manifold. As depicted in FIG. 1, the pump 70 is connected to the annulus 20 via the BOP stack 42, but in other examples the pump 70 could be connected to the return line 30, or to the choke manifold 32.

Alternatively, or in addition, fluid could be diverted from the standpipe manifold (or otherwise from the rig pump 68) to the return line 30 when needed, as described in International Application Serial No. PCT/US08/87686, as described in U.S. application Ser. No. 13/022,964, or using other techniques.

Restriction by the choke 34 of such fluid flow from the rig pump 68 and/or the backpressure pump 70 will thereby cause pressure to be applied to the annulus 20. If the backpressure pump 70 is implemented, a flowmeter 72 can be used to measure the output of the pump.

The choke 34 and backpressure pump 70 are examples of pressure control devices which can be used to control pressure in the annulus 20 near the surface. Other types of pressure control devices (such as those described in International Application Serial No. PCT/US08/87686, and in U.S. application Ser. No. 13/022,964, etc.) may be used, if desired.

Figure 2:
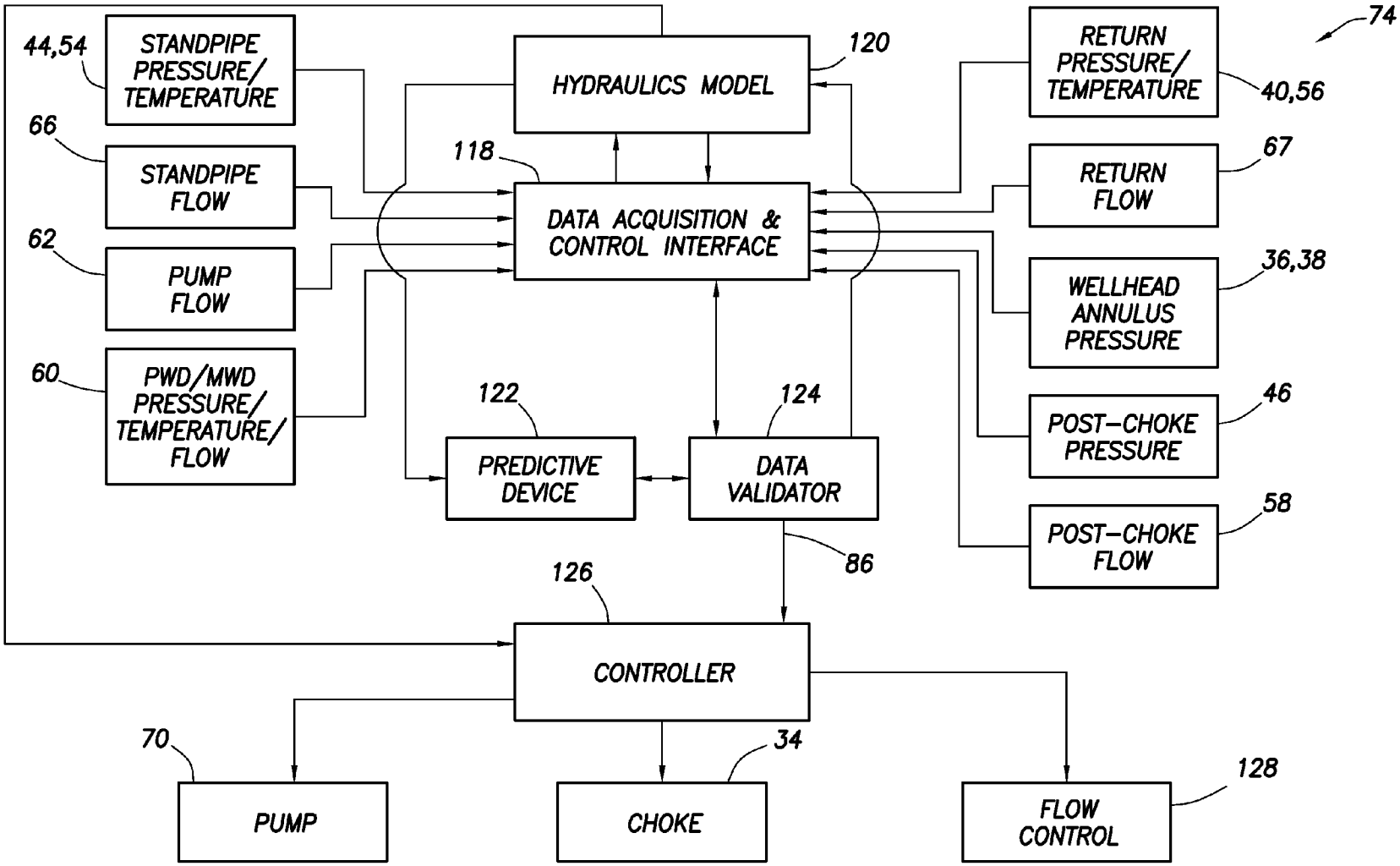
FIG. 2 is a representative block diagram of a process control system which may be used with the well system and method of FIG. 1.

Referring additionally now to FIG. 2, a block diagram of one example of a process control system 74 is representatively illustrated. In other examples, the process control system 74 could include other numbers, types, combinations, etc., of elements, and any of the elements could be positioned at different locations or integrated with another element, in keeping with the scope of this disclosure.

As depicted in FIG. 2, the process control system 74 includes a data acquisition and control interface 118, a hydraulics model 120, a predictive device 122, a data validator 124 and a controller 126. These elements may be similar to those described in International Application Serial No. PCT/US10/56433 filed on 12 Nov. 2010.

The hydraulics model 120 is used to determine a desired pressure in the annulus 20 to thereby achieve a desired pressure at a certain location in the wellbore 12. The hydraulics model 120, using data such as wellbore depth, drill string rpm, running speed, mud type, etc., models the wellbore 12, the drill string 16, flow of the fluid through the drill string and annulus 20 (including equivalent circulating density due to such flow), etc.

The data acquisition and control interface 118 receives data from the various sensors 36, 38, 40, 44, 46, 54, 56, 58, 60, 62, 66, 67, 72, together with rig and downhole data, and relays this data to the hydraulics model 120 and the data validator 124. In addition, the interface 118 relays the desired annulus pressure from the hydraulics model 120 to the data validator 124.

The predictive device 122 can be included in this example to determine, based on past data, what sensor data should currently be received and what the desired annulus pressure should be. The predictive device 122 could comprise a neural network, a genetic algorithm, fuzzy logic, etc., or any combination of predictive elements, to produce predictions of the sensor data and desired annulus pressure.

The data validator 124 uses these predictions to determine whether any particular sensor data is valid, whether the desired annulus pressure output by the hydraulics model 120 is appropriate, etc. If it is appropriate, the data validator 124 transmits the desired annulus pressure to the controller 126 (such as a programmable logic controller, which may include a proportional integral derivative (PID) controller), which controls operation of the choke 34, the pump 70 and the various flow control devices 128 (such as valves, etc.).

In this manner, the choke 34, pump 70 and flow control devices 128 can be automatically controlled to achieve and maintain the desired pressure in the annulus 20. Actual pressure in the annulus 20 is typically measured at or near the wellhead 24 (for example, using sensors 36, 38, 40), which may be at a land or subsea location.

Figure 3:
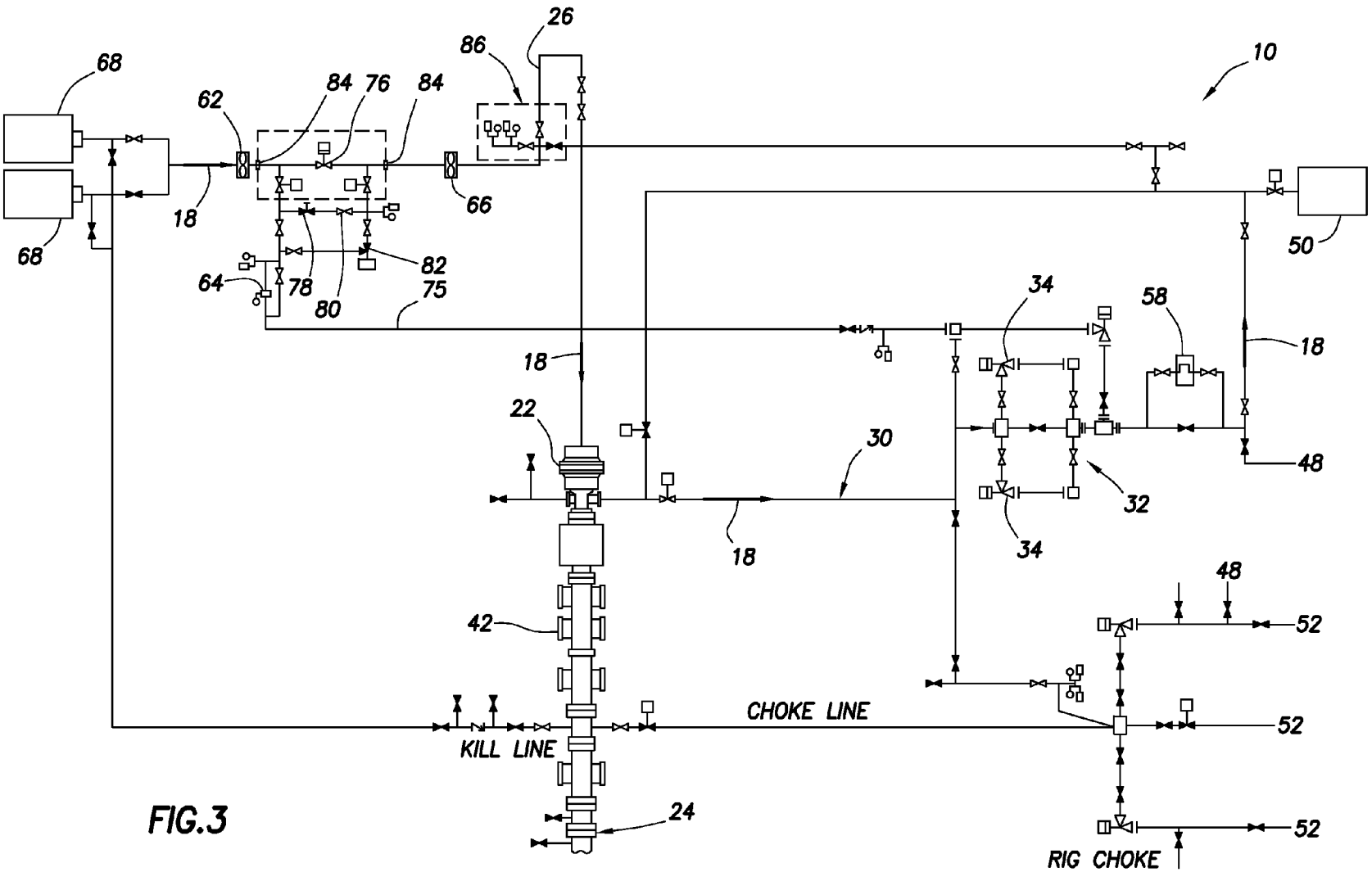
FIG. 3 is a representative view of another configuration of the well system.

Referring additionally now to FIG. 3, another configuration of the well drilling system 10 is representatively and schematically illustrated. In this configuration, a flow control device 76 is connected upstream of the rig's standpipe manifold 86. The flow control device 76 can be interconnected between the rig pump 68 and the standpipe manifold 86 using, for example, quick connectors 84 (such as, hammer unions, etc.). This will allow the flow control device 76 to be conveniently adapted for interconnection in various rigs' pump lines.

A specially adapted fully automated flow control device 76 (e.g., as one of the flow control devices 128 controlled automatically by the controller 126) can be used for controlling flow through the standpipe line 26, instead of using the conventional standpipe valve in the rig's standpipe manifold 86. The flow control device 76, along with one or more additional flow control devices 78, 80, 82 can be used to divert flow of the fluid 18 from the rig pump(s) 68 to the choke manifold 32 via a bypass line 75.

Figure 4:
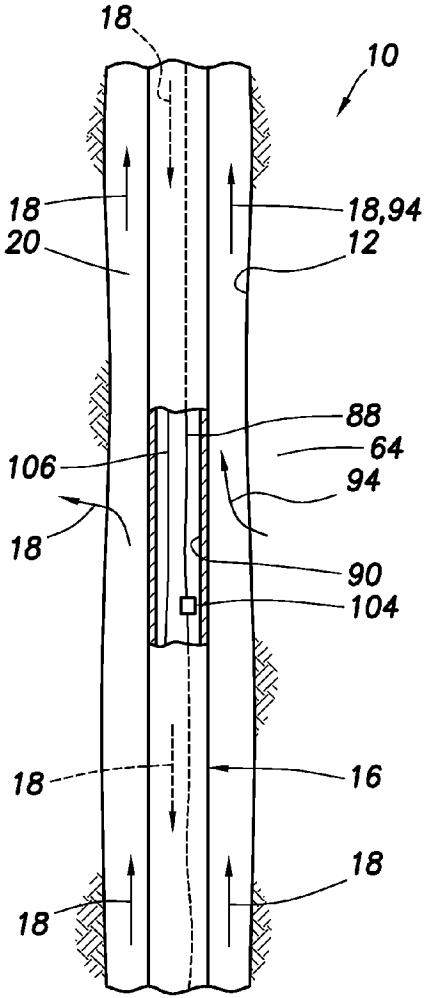
FIG. 4 is an enlarged scale representative partially cross-sectional view of a portion of the well system.

Referring additionally now to FIG. 4, a configuration of the well system 10 is representatively illustrated. In this configuration, the drill string 16 comprises coiled tubing or otherwise continuous tubing, which has at least one optical waveguide 88 (such as, an optical fiber, ribbon, etc.) extending along its length.

In FIG. 4, the waveguide 88 is depicted as extending through an interior longitudinal flow passage 90 of the drill string 16, but in other examples the waveguide may extend in a sidewall of the drill string, exterior to the drill string, etc. The waveguide 88 may be in the form of a loop that starts at the top of the coiled tubing, extends to the bottom, turns around and returns to the surface for improved temperature measurement performance.

Multiple optical waveguides 88 could be provided, along with other types of lines (e.g., electrical lines and/or hydraulic lines, etc.). The various lines may be incorporated into a cable having additional components, such as armor, insulation, cladding, electrical lines, hydraulic lines and/or shielding, etc., or they may be separately installed in the drill string 16.

The optical waveguide 88 may be installed in a tube or control line with the drill string 16. Preferably, both single mode and multimode optical waveguides 88 are provided, but such is not necessary in keeping with the principles of this disclosure.

The drill string 16 is preferably continuous (e.g., not jointed or segmented) at least from the wellhead 24 to near a bottom hole assembly (e.g., including but not limited to the sensors 60, non-return valve 21, drill bit 14, a mud motor 92 (see FIG. 1) which rotates the drill bit in response to flow of the fluid 18 through the drill string, etc.). The waveguide 88 may be installed in the drill string 16 before or after the drill string is conveyed into the wellbore 12.

The left-hand side of FIG. 4 depicts a situation in which the fluid 18 is lost to the formation 64. That is, the fluid 18 flows from the wellbore 12 into the formation 64.

This situation can occur, for example, when the pressure in the wellbore 12 is greater than the fracture pressure of the formation 64. Such a situation is generally to be avoided, but can be used to advantage (e.g., in order to conveniently determine the fracture pressure, etc.), as described more fully below.

The right-hand side of FIG. 4 depicts another situation in which formation fluid 94 flows into the wellbore 12 from the formation 64. This situation can occur, for example, when the pressure in the wellbore 12 is less than the pore pressure of the formation 64.

Generally, such a situation is desirable in underbalanced drilling operations (e.g., with controlled influx of the formation fluid 94 into the wellbore 12 while drilling), but is undesired in other types of drilling operations (e.g., managed pressure drilling, conventional overbalanced drilling, etc.). In a technique described more fully below, influx of the formation fluid 94 into the wellbore 12 can be used to conveniently determine the pore pressure of the formation 64.

Note that the fluid 18 would not be flowing into the formation 64 (as depicted on the left-hand side of FIG. 4) concurrently with the fluid 94 flowing into the wellbore 12 (as depicted on the right-hand side of FIG. 4). Thus, the situations depicted on the left- and right-hand sides of FIG. 4 would not occur simultaneously, but instead are used to illustrate separate situations which can occur during a drilling operation.

Figure 5:
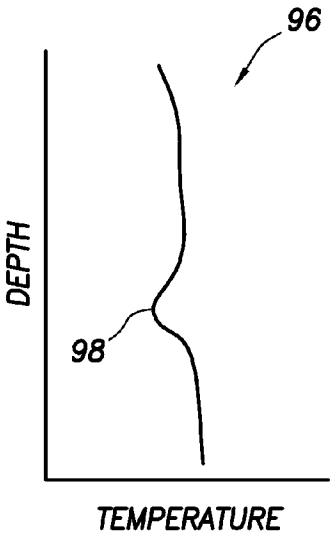
FIG. 5 is a representative graph of temperature versus depth along the wellbore, the graph containing an indication of fluid loss from the wellbore.

In FIG. 5, a representative graph 96 of temperature versus depth is depicted for the section of the wellbore 12 illustrated in FIG. 4, and for the fluid 18 loss situation shown on the left-hand side of FIG. 4. Note that a temperature decrease 98 is detected at the location where the fluid 18 enters the formation 64.

The temperature decrease 98 is due to the fluid 18 locally cooling the formation 64 at the location where the fluid enters the formation. Such a temperature decrease 98 anomaly can be used to detect where and when a fluid 18 loss event occurs, and can be used to determine when the fracture pressure of the formation 64 has been reached.

Figure 6:
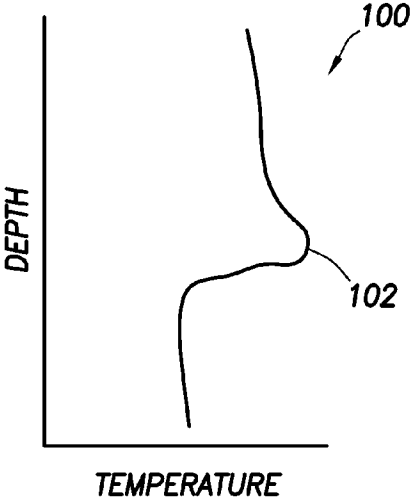
FIG. 6 is a representative graph of temperature versus depth along the wellbore, the graph containing an indication of fluid influx into the wellbore.

In FIG. 6, a representative graph 100 of temperature versus depth is depicted for the section of the wellbore 12 illustrated in FIG. 4, and for the fluid 94 influx situation shown on the right-hand side of FIG. 4. Note that a temperature increase 102 is detected at the location where the fluid 94 enters the wellbore 12.

The temperature increase 102 is due to the fluid 94 locally heating the wellbore 12 at the location where the fluid enters the wellbore. Such a temperature increase 102 anomaly can be used to detect where and when a fluid 94 influx event occurs, and can be used to determine when the pressure in the wellbore becomes less than the pore pressure of the formation 64.

Preferably, temperature is measured with the optical waveguide 88 using the well-known technique of distributed temperature sensing (DTS). DTS is a technology that can be used to measure temperature distribution along the optical waveguide 88.

A pulsed laser source can be used to send a pulse of light through the optical waveguide 88, and properties of returning light can be recorded. The returning light ("backscatter") comprises absorption and retransmission of light energy.

The backscattered light includes different spectral components, e.g., Rayleigh, Brillouin, and Raman bands. The Raman band can be used to obtain temperature information along the fiber.

The Raman backscatter has two components, Stokes and Anti-Stokes, the former being weakly dependent on temperature and the latter being greatly influenced by temperature. The relative intensity between the Stokes and Anti-Stokes components is a function of temperature at which the backscattering occurs.

Since the speed of light in glass is known, it is possible to determine, by tracking the arrival time of the reflected and backscattered light, the precise location where the backscattered light originated. A DTS trace or profile (such as the graphs 96, 100 of FIGS. 5 & 6) is a set of temperature measurements or sample points, equally spaced along the waveguide 88 length.

Brillouin backscatter wavelength is also temperature dependent and, thus, can be used for DTS. However, the Brillouin backscatter is also dependent on localized strain in the waveguide 88, and so for temperature measurements, the strain component can be eliminated (e.g., by ensuring that the waveguide is not subjected to strain), canceled out, etc.

In the example of FIG. 4, the optical waveguide 88 is used for DTS monitoring. However, other distributed optical measurement techniques may be used, if desired. For example, distributed acoustic sensing (DAS), distributed strain sensing (DSS) or distributed vibration sensing (DVS) may be used.

As discussed above, Raman backscatter sensing is typically used for DTS monitoring, but Brillouin backscatter sensing can also be used, if desired. Brillouin or Rayleigh backscatter sensing may be used for DAS, DSS or DVS monitoring, with preferably Brillouin backscatter gain or coherent Rayleigh backscatter being sensed. Interferometric optical sensing may also (or alternatively) be used, as well.

In one example, DAS may be used to sense the acoustic signal produced when the fluid 94 flows into the wellbore 12 from the formation 64 (e.g., a fluid influx), or a decreased acoustic amplitude due to the fluid 18 flowing from the wellbore into the formation (e.g., a fluid loss). Other characteristics of the drilling operation (such as drill string 16 vibration, stick-slip, whirl, strain, etc.) may also, or alternatively, be measured using the optical waveguide 88.

DAS may be used to detect an acoustic signature of gas entering the wellbore 12 from the formation 64, and/or of gas flowing through the annulus 20. For example, the waveguide 88 will indicate less damped acoustic ringing in portions of the drill string 16 exposed to gas in the wellbore 12, so optical equipment connected to the waveguide can be used to detect distributed acoustic resonance in the drill string for this purpose.

This can provide an early gas kick detection system, whereby not only the influx event can be detected, but also the location of the influx into the wellbore 12, and the location and velocity of the gas in the annulus 20, can be detected. Such information can allow rig personnel to make appropriate adjustments at appropriate times to circulate the gas out of the wellbore 12, and to prevent further influxes.

DAS can be used to detect acoustic waves produced by another drill string (not shown) in another close wellbore (not shown). While the other drill string drills the other wellbore, the waveguide 88 detects the acoustic waves produced by the other drill string, so that the location of the other wellbore relative to the wellbore 12 can be readily determined, in order to guide the wellbores to intersect or avoid each other.

DAS can be used to detect other events in or out of the wellbore 12 which can produce an acoustic signal. For example, a washout occurring in the wellbore 12 could be detected by the waveguide 88. As another example, a seismic source could be activated at the surface, in another wellbore, etc., and the seismic vibrations could be detected by the waveguide 88.

In addition to the distributed measurements, point measurement of properties can be made using one or more sensors 104. For example, the sensors 104 could include a pressure sensor, a chemical ion or pH sensor, an ionizing radiation sensor, a magnetic field sensor, etc. The sensors 104 could be optical or other types of sensors, and may or not be connected to or part of the waveguide 88.

In another example, the sensors 104 are not necessarily optically coupled to the waveguide 88. Instead, the sensors 104 could communicate acoustically with the waveguide 88. In this example, the sensors 104 could emit acoustic signals on which their measurements are modulated (e.g., using frequency, phase or amplitude shift keying, etc.), the acoustic signals could be received by the waveguide 88 and transmitted optically (as backscatter variations) to a remote location (such as, the earth's surface, a drilling rig, a sea floor wellhead, etc.).

Additional one or more lines 106 can be provided, if desired. In one example, a line 106 comprises an electrical conductor which serves as an antenna to induce a magnetic field in the formation 64. Variations in the magnetic field are indicative of resistivity changes in the formation 64.

The well-known Faraday effect in the waveguide 88 can be detected as an indication of the magnetic field changes in the formation 64. In this example, the drill string 16 could be made of a composite or other non-magnetic material, so that it does not interfere with propagating the magnetic field into the formation 64, and with detecting the magnetic field variations in the formation.

In one example, logging can be performed with the waveguide 88 while the drilling operation progresses. The waveguide 88 can, for example, detect gamma radiation from the formation 64. In this manner, an operator can know when particular subterranean strata are penetrated, the strata adjacent the drill string 16 can be correlated to expected subterranean strata, etc. The drill string 16 would preferably be made of a composite or other non-metal material in this example.

Ionizing radiation can be detected along the waveguide 88 by providing a phosphorescent or fluorescent cladding on the waveguide. Different strata can have different spectral absorbing signatures, allowing for identification and verification of the strata based on the signatures.

Although only certain examples of distributed and point sensing techniques utilizing the waveguide 88 are described above, it should be clearly understood that any sensing techniques, and any number or combination of sensing techniques, may be used in keeping with the principles of this disclosure.

Figure 7:
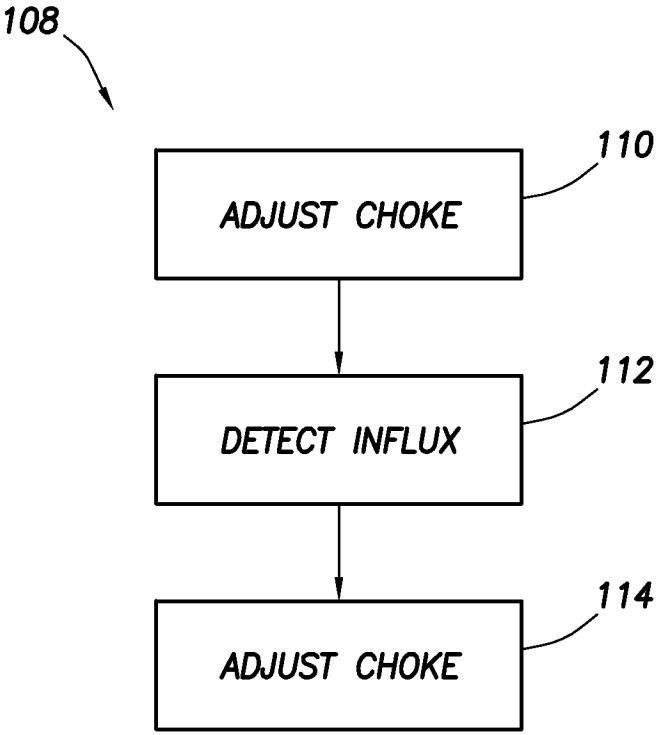
FIG. 7 is a representative flowchart for a method of detecting an influx and adjusting a choke in response, which method can embody principles of this disclosure.

Referring additionally now to FIG. 7, a method 108 which may be used with the well system 10 configuration of FIG. 4 is representatively illustrated in flowchart form. Of course, the method 108 could be practiced with other well systems, in keeping with the principles of this disclosure.

In the method 108, an influx of formation fluid 94 is detected as an indication of the pore pressure of the formation 64. When the pressure in the wellbore 12 at a certain location is less than pore pressure of the formation 64 at that location, the formation fluid 94 is induced by the pressure differential to flow toward and into the wellbore.

Thus, the point at which an influx starts is the point at which pressure in the wellbore 12 becomes less than the pore pressure of the formation 64. Pressure in the wellbore 12 can be readily measured (e.g., using sensors 60, 104, etc.), and pressure in the annulus 20 near the surface can be conveniently measured (e.g., using sensors 38, 40, etc.), when such an influx occurs.

Note that the pressure in the wellbore 12 at the location of the influx can include friction pressure due to flow of the fluid 18 (also known as equivalent circulating density), so this pressure (if any) is preferably taken into account when determining the actual pressure in the wellbore at the location of the influx. It is not necessary, however, for the fluid 18 to be circulating through the drill string 16 and annulus 20 while the method 108 is performed. Instead, the pump 70 (see FIG. 1) and/or rig pump 68 (see FIG. 3) could be used to supply flow through the choke 34 during the method 108, without the fluid 18 circulating through the drill string 16 and annulus 20.

In step 110 of the method 108, the choke 34 is adjusted to gradually decrease pressure in the wellbore 12. By decreasing resistance to flow through the choke 34 (e.g., by gradually opening the choke), pressure upstream of the choke is reduced and, thus, pressure applied to the annulus 20 near the surface is reduced.

In step 112, an influx is detected. For example, using DAS or DTS with the waveguide 88 as described above, an acoustic or thermal indication of the influx can be readily detected (e.g., as depicted in FIG. 6).

The pressure in the wellbore 12 at the location of the influx can be measured (e.g., using sensors 60, 104, etc.) and/or pressure in the annulus 20 near the surface can be measured (e.g., using sensors 38, 40, etc.) at the time of the influx. These pressure measurements will indicate the pore pressure of the formation 64 at the location of the influx.

In step 114, the choke 34 is adjusted as needed for the particular drilling operation. For example, in managed pressure drilling, the choke 34 may be adjusted so that pressure in the wellbore 12 is somewhat greater than pore pressure of the formation 64 (which can be subsequently verified by a lack of influx as detected by the waveguide 88 after adjustment of the choke). In underbalanced drilling, the choke 34 may be adjusted so that a controlled amount of influx is permitted during drilling (which can be subsequently verified by the waveguide 88 after adjustment of the choke).

Figure 8:
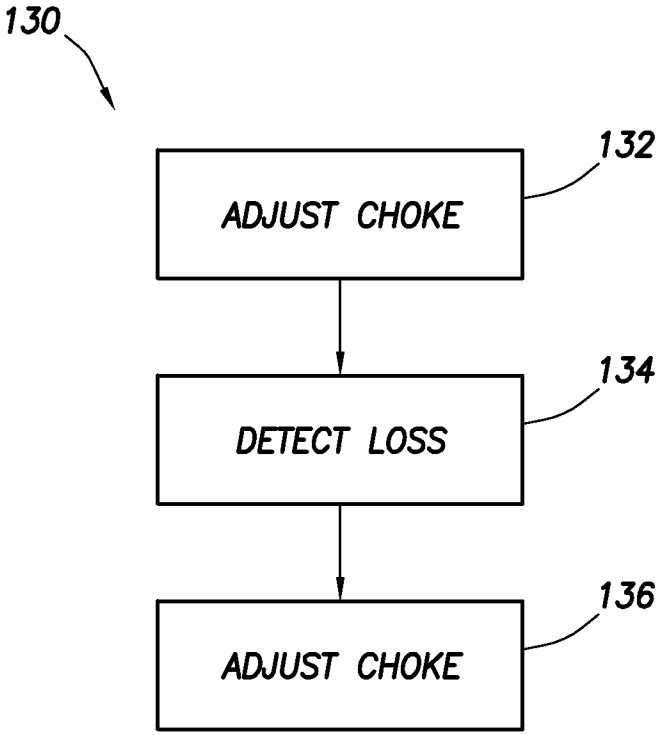
FIG. 8 is a representative flowchart for a method of detecting a fluid loss and adjusting a choke in response, which method can embody principles of this disclosure.

Referring additionally now to FIG. 8, another method 130 which may be used with the well system 10 configuration of FIG. 4 is representatively illustrated in flowchart form. Of course, the method 130 could be practiced with other well systems, in keeping with the principles of this disclosure.

In the method 130, a loss of fluid 18 to the formation 64 is detected as an indication of the fracture pressure of the formation. When the pressure in the wellbore 12 at a certain location is greater than the fracture pressure of the formation 64 at that location, the formation can fracture and the fluid 18 can readily flow into the formation.

Thus, the point at which a loss of fluid 18 begins is the point at which pressure in the wellbore 12 becomes more than the fracture pressure of the formation 64. Pressure in the wellbore 12 can be readily measured (e.g., using sensors 60, 104, etc.), and pressure in the annulus 20 near the surface can be conveniently measured (e.g., using sensors 38, 40, etc.) at the time of the loss of fluid 18.

Note that the pressure in the wellbore 12 at the location of the fluid loss can include friction pressure due to flow of the fluid 18 (also known as equivalent circulating density), so this pressure (if any) is preferably taken into account when determining the actual pressure in the wellbore at the location of the loss of fluid. It is not necessary, however, for the fluid 18 to be circulating through the drill string 16 and annulus 20 while the method 130 is performed. Instead, the pump 70 (see FIG. 1) and/or rig pump 68 (see FIG. 3) could be used to supply flow through the choke 34 during the method 130, without the fluid 18 circulating through the drill string 16 and annulus 20.

In step 132 of the method 130, the choke 34 is adjusted to gradually increase pressure in the wellbore 12. By increasing resistance to flow through the choke 34 (e.g., by gradually closing the choke), pressure upstream of the choke is increased and, thus, pressure applied to the annulus 20 near the surface is increased.

In step 134, a loss of fluid 18 is detected. For example, using DAS or DTS with the waveguide 88 as described above, an acoustic or thermal indication of the loss of fluid 18 can be readily detected (e.g., as depicted in FIG. 5).

The pressure in the wellbore 12 at the location of the fluid loss can be measured (e.g., using sensors 60, 104, etc.) and/or pressure in the annulus 20 near the surface can be measured (e.g., using sensors 38, 40, etc.) at the time of the loss. These pressure measurements will indicate the fracture pressure of the formation 64 at the location of the fluid loss.

In step 136, the choke 34 is adjusted as needed for the particular drilling operation. For example, in managed pressure drilling, the choke 34 may be adjusted so that pressure in the wellbore 12 is somewhat greater than pore pressure of the formation 64 (which can be subsequently verified by a lack of influx as detected by the waveguide 88 after adjustment of the choke) and less than fracture pressure of the formation. In underbalanced drilling, the choke 34 may be adjusted so that a controlled amount of influx is permitted during drilling (which can be subsequently verified by the waveguide 88 after adjustment of the choke).

It may now be appreciated that the above disclosure provides several advancements to the arts of wellbore pressure control and parameter sensing in drilling operations. In the example of FIG. 4, the coiled or otherwise continuous tubing drill string 16 includes the optical waveguide 88 which provides for distributed and/or point sensing of various parameters. The use of a continuous tubing drill string 16 with the optical waveguide 88 therein provides for convenient tripping of the drill string and waveguide into and out of the wellbore 12, with no need for attaching the waveguide to, or detaching the waveguide from, an exterior of the drill string as sections of the drill string are connected to or disconnected from the drill string.

The above disclosure describes a method of drilling a wellbore 12. The method can include drilling the wellbore 12 with a continuous tubing drill string 16, and sensing at least one parameter with an optical waveguide 88 in the drill string 16.

The drill string 16 may be continuous at least from a surface location to a bottom hole assembly of the drill string 16.

Sensing at least one parameter can comprise sensing the parameter as distributed along the drill string 16.

Distributed acoustic sensing (DAS), distributed temperature sensing (DTS), distributed vibration sensing (DVS) and/or distributed strain sensing (DSS) may be included in sensing at least one parameter.

The sensed parameter may be selected from the group comprising pressure, temperature, chemical ion, ionizing radiation, pH, magnetic field and gamma radiation. Of course, any other parameter(s), and any number or combination of parameters, may be sensed in keeping with the principles of this disclosure.

The method 108 can include adjusting a choke 34, thereby inducing an influx of fluid 94 into the wellbore 12, and sensing at least one parameter may include detecting the influx. The method 108 may also include measuring pressure in the wellbore 12 when detecting the influx, thereby correlating the pressure in the wellbore 12 to pore pressure in a formation 64 intersected by the wellbore 12. The method 108 may also include adjusting the choke 34 in response to detecting the influx.

The method 130 can include adjusting a choke 34, thereby inducing a loss of fluid 18 from the wellbore 12, and sensing at least one parameter may include detecting the loss of fluid 18. The method 130 may also include measuring pressure in the wellbore 12 when detecting the loss of fluid 18, thereby correlating the pressure in the wellbore 12 to fracture pressure in a formation 64 intersected by the wellbore 12. The method 130 may also include adjusting the choke 34 in response to detecting the loss of fluid 18.

The optical waveguide 88 may be positioned in an interior flow passage 90 of the drill string 16.

Also described by the above disclosure is a well system 10. The well system 10 may include a continuous tubing drill string 16, and an optical waveguide 88 in the drill string 16. The optical waveguide 88 may sense at least one parameter along the drill string 16.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of drilling a wellbore, the method comprising:

drilling the wellbore with a continuous tubing drill string; and sensing at least one parameter with an optical waveguide in the drill string, the sensing comprising detecting optical back scatter along the optical waveguide.

2. The method of claim 1, wherein the drill string is continuous at least from a surface location to a bottom hole assembly of the drill string.

3. The method of claim 1, wherein sensing at least one parameter comprises sensing the parameter as distributed along the drill string.

4. The method of claim 1, wherein sensing at least one parameter comprises distributed acoustic sensing.

5. The method of claim 1, wherein sensing at least one parameter comprises distributed temperature sensing.

6. The method of claim 1, wherein sensing at least one parameter comprises distributed vibration sensing.

7. The method of claim 1, wherein sensing at least one parameter comprises distributed strain sensing.

8. The method of claim 1, wherein the at least one parameter is selected from the group comprising pressure, temperature, chemical ion, ionizing radiation, pH, magnetic field and gamma radiation.

9. The method of claim 1, further comprising adjusting a choke, thereby inducing an influx of fluid into the wellbore, and wherein sensing at least one parameter further comprises detecting the influx.

10. The method of claim 9, further comprising measuring pressure in the wellbore when detecting the influx, wherein the pressure in the wellbore is correlated to pore pressure in a formation intersected by the wellbore.

11. The method of claim 9, further comprising adjusting the choke in response to detecting the influx.

12. The method of claim 1, further comprising adjusting a choke, thereby inducing a loss of fluid from the wellbore, and wherein sensing at least one parameter further comprises detecting the loss of fluid.

13. The method of claim 12, further comprising measuring pressure in the wellbore when detecting the loss of fluid, wherein the pressure in the wellbore is correlated to fracture pressure in a formation intersected by the wellbore.

14. The method of claim 12, further comprising adjusting the choke in response to detecting the loss of fluid.

15. The method of claim 1, wherein the optical waveguide is positioned in an interior flow passage of the drill string.

16. A well system, comprising:

a continuous tubing drill string; and an optical waveguide in the drill string, wherein the optical waveguide senses at least one parameter along the drill string, via detection of optical back scatter along the optical waveguide.

17. The system of claim 16, wherein the drill string is continuous at least from a surface location to a bottom hole assembly of the drill string.

18. The system of claim 16, wherein the optical waveguide senses the at least one parameter as distributed along the drill string.

19. The system of claim 16, wherein the at least one parameter comprises distributed acoustic waves.

20. The system of claim 16, wherein the at least one parameter comprises distributed temperature.

21. The system of claim 16, wherein the at least one parameter comprises distributed vibration.

22. The system of claim 16, wherein the at least one parameter comprises distributed strain.

23. The system of claim 16, wherein the at least one parameter is selected from the group comprising pressure, temperature, chemical ion, ionizing radiation, pH, magnetic field and gamma radiation.

24. The system of claim 16, further comprising a choke, adjustment of which induces an influx of fluid into the wellbore, and wherein the at least one parameter comprises an indication of the influx.

25. The system of claim 24, wherein pressure in the wellbore at the indication of the influx is correlated to pore pressure in a formation intersected by the wellbore.

26. The system of claim 24, wherein the choke is adjusted in response to the indication of the influx.

27. The system of claim 16, further comprising a choke, adjustment of which induces a loss of fluid from the wellbore, and wherein the at least one parameter comprises an indication of the loss of fluid.

28. The system of claim 27, wherein pressure in the wellbore at the indication of the loss of fluid is correlated to fracture pressure in a formation intersected by the wellbore.

29. The system of claim 27, wherein the choke is adjusted in response to the indication of the loss of fluid.

30. The system of claim 16, wherein the optical waveguide is positioned in an interior flow passage of the drill string.

* * * * *

UNITED STATES PATENT AND TRADEMARK OFFICE

CERTIFICATE OF CORRECTION

PATENT NO. : 8,573,325 B2
APPLICATION NO. : 13/775934
DATED : November 5, 2013
INVENTOR(S) : John L. Maida, Jr. and Neal G. Skinner It is certified that error appears in the above-identified patent and that said Letters Patent is hereby corrected as shown below:

On the Title Page, below Item (65) insert

-- (30) Foreign Application Priority Data
2 June 2011 (WO) ..... PCT/US11/38838 --.

Signed and Sealed this
Twenty-fifth Day of February, 2014

Michelle K. Lee

Michelle K. Lee
*Deputy Director of the United States Patent and Trademark Office*